US011821189B1

(12) United States Patent
Stanfield

(10) Patent No.: US 11,821,189 B1
(45) Date of Patent: Nov. 21, 2023

(54) TOILET BOWL CLEANING SYSTEM

(71) Applicant: Jerald Christopher Stanfield, Gilbert, AZ (US)

(72) Inventor: Jerald Christopher Stanfield, Gilbert, AZ (US)

( * ) Notice: Subject to any disclaimer, the term of this patent is extended or adjusted under 35 U.S.C. 154(b) by 0 days.

(21) Appl. No.: 17/892,667

(22) Filed: Aug. 22, 2022

(51) Int. Cl.
*E03D 9/03* (2006.01)

(52) U.S. Cl.
CPC ..... *E03D 9/038* (2013.01)

(58) Field of Classification Search
CPC ..... E03D 9/098; E03D 9/033; E03D 9/03; E03D 9/02
USPC ..... 4/227.6
See application file for complete search history.

(56) References Cited

U.S. PATENT DOCUMENTS 2,570,934 A * 10/1951 Foster ..... E03D 9/037 4/225.1
3,228,040 A * 1/1966 Currie ..... E03D 9/037 4/225.1
3,290,698 A * 12/1966 Joyner ..... E03D 9/037 4/225.1
3,311,931 A * 4/1967 Kristensen ..... E03D 9/037 4/225.1
6,321,392 B1 11/2001 Sim
10,570,600 B2 2/2020 Holguin
2004/0117899 A1 6/2004 Nguyen et al.
2015/0013058 A1 1/2015 Bucher et al.

* cited by examiner

*Primary Examiner* — Huyen D Le
(74) *Attorney, Agent, or Firm* — SNELL & WILMER L.L.P.

(57) ABSTRACT

The system may comprise a holding device having a first portion and a second portion; the holding device configured to receive fill water; the first portion of the holding device configured to retain a cleaning substance; the second portion of the holding device configured to allow the fill water to flow into an overflow pipe; a second leg having a first end interfacing with the holding device; the second leg having a second end configured to be reciprocally received into the overflow pipe to allow the fill water to flow into the overflow pipe; a first leg having a first end interfacing with the holding device; and the first leg having a second end configured to abut a bottom of an inside of a tank of a toilet.

20 Claims, 2 Drawing Sheets

TOILET BOWL CLEANING SYSTEM

TECHNICAL FIELD

This disclosure generally relates to a toilet bowl cleaning system that keeps the cleaner away from the tank parts.

BACKGROUND

Toilets need to be cleaned often, but people do not like to manually clean toilets. Many chemicals, devices and systems exist to clean toilets such as, for example, liquid sprays, tank tablets, push on gel tabs for the bowl, hanging tabs on the bowl lid, brushes and disposable sponges. However, people may not want to use cleaning products that are dispersed directly into the bowl since those products may be unsightly and people do not want such chemicals near their bodies. Other cleaning systems exist that work in the tank, but such tank cleaning systems include chemicals that interface with the tank parts. The chemicals that are dispersed in the tank may damage the tank parts over time. As such, a need exists for a self-cleaning toilet bowl system that is placed in the tank, but the chemicals go directly into the bowl and do not interact with the tank parts.

As set forth in FIG. 1, a typical toilet operates by pushing on a handle 105 that opens a plug 110 (or flapper) in a tank 115. The opening of the plug 110 allows the water to flow out of the tank 115 and into the bowl to help wash down the dirty water out of the bowl and into the sanitation lines. The float rod 120 goes down when the water leaves the tank 115, so the downward movement of the float rod 120 opens the valve to allow clean water to enter into the tank 115. The clean water also travels through a fill tube 125 and into the overflow pipe 130 to partially fill the bowl with clean water. As the tank 115 fills, the float rod 120 rises with the water. When the water reaches the optimum level, the float rod 120 closes the valve and restricts additional water flowing into the tank 115. If water continues to flow into the tank 115, the water level may rise above the top opening of the overflow pipe 130. The water that rises in the tank 115 above the top opening of the overflow pipe 130 enters the overflow pipe 130, then exits the overflow pipe 130 and into the bowl.

SUMMARY

Systems and methods are disclosed for an improved toilet bowl cleaning system. In various embodiments, the system may comprise a holding device 135 having a first portion 140 and a second portion 145; the holding device 135 configured to receive fill water; the first portion 140 of the holding device 135 configured to retain a cleaning substance 150; the second portion 145 of the holding device 135 configured to allow the fill water to flow into an overflow pipe 130; a second leg 160 having a first end interfacing with the holding device 135; the second leg 160 having a second end configured to be reciprocally received into the overflow pipe 130 to allow the fill water to flow into the overflow pipe 130; a first leg 165 having a first end interfacing with the holding device 135.

The first portion 140 of the holding device 135 may include a recessed area. the first portion 140 of the holding device 135 may include a recessed area having a geometric shape that matches a geometric shape of the cleaning substance 150. The holding device 135 may include a side wall. The holding device 135 may include a side wall that is about ⅜ of an inch above a bottom of the holding device 135. The first portion 140 of the holding device 135 is about 1.5 inch×1 inch×3 inch. The holding device 135 may be configured to receive fill water from a fill tube 125. An end of the fill tube 125 may be clipped to the side of the holding device 135. The holding device 135 may include a cover. The holding device 135 may include at least one of a removable cover, a hinged cover or a sliding cover. The second end of the second leg 160 and/or the bottom end of the second leg may include a rubber band. A bottom of the second portion 145 of the holding device 135 may include one or more ridges. The first portion 140 of the holding device 135 may be configured to allow at least one of a re-fill or replacement of the cleaning substance 150. A geometric shape of the cleaning substance 150 may be similar to the geometric shape of the first portion 140 of the holding device 135. The first portion 140 of the holding device 135 may be configured to directly receive the cleaning substance 150.

In various embodiments, the system may comprise a holding device 135 having a first portion 140 and a second portion 145; the holding device 135 configured to receive fill water; the holding device 135 integrated with an overflow pipe 130; the first portion 140 of the holding device 135 configured to retain a cleaning substance 150; and the second portion 145 of the holding device 135 configured to allow the fill water to flow into an overflow pipe 130.

BRIEF DESCRIPTION OF THE DRAWINGS

The accompanying drawings, wherein like numerals depict like elements, illustrate exemplary embodiments of the present disclosure, and together with the description, serve to explain the principles of the disclosure. In the drawings.

DETAILED DESCRIPTION

Figure 1:
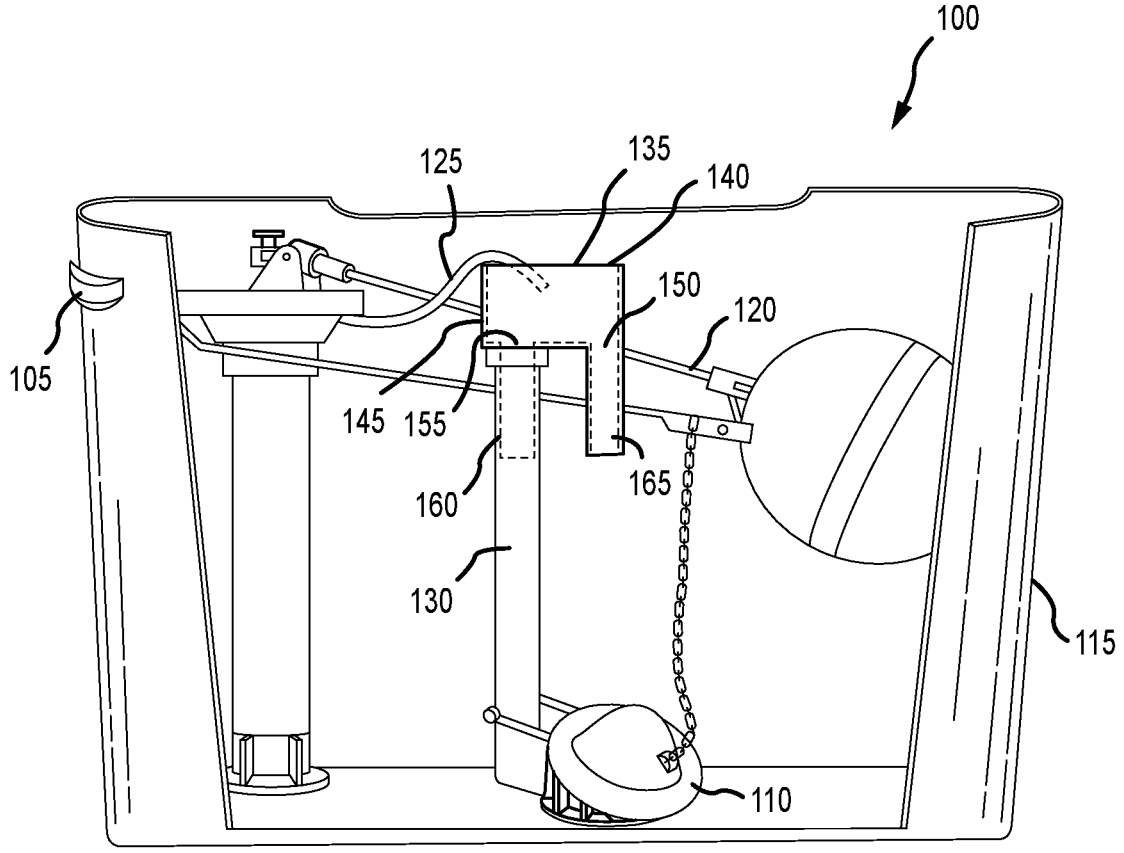
FIG. 1 illustrates a toilet bowl system having the toilet bowl cleaning device mounted within the overflow pipe, in accordance with various embodiments.

In various embodiments, as set forth in FIG. 1, the system may include any holding device 135 in the tank 115 that is configured to allow fill water from a fill tube 125 to interact or mix with a cleaning substance 150, then flow into the bowl. The interaction or mixing with the cleaning substance 150 may include the fill water going onto, over and/or through a cleaning substance 150, or the cleaning substance 150 being added to the fill water. The cleaning substance 150 may be in the form of a powder, gel, liquid, tablet, pod or any other form that may be placed, added or loaded into the holding device 135. The cleaning substance 150 may be configured in any shape. For example, the cleaning substance 150 may be a rectangle or a round shape. The cleaning substance 150 shape may match the shape of the holding device 135 (e.g., the shape of a first portion 140 of the holding device 135). The cleaning substance 150 may be placed directly into the holding device 135, which avoids the expense and hassle of finding and using proprietary cleaning cartridges.

In various embodiments, with continued reference to FIG. 1, the holding device 135 may be configured to fit over, on top of and/or adjacent to the opening of the overflow pipe 130. As such, the holding device 135 does not need to attach to the side of the tank 115. The holding device 135 may include a cover. The cover may be a removable cover, a hinged cover or a sliding cover. The fill water exits a hole 155 in the holding device 135 and runs into the opening of the overflow pipe 130. The holding device 135 may have a leg that may simply slide within the existing overflow pipe 130, so the holding device 135 may be easily installed by the homeowner. Because the cleaning agent (or the fill water with the cleaning agent) does not interface with any of the existing components (tubes, washers, flappers, etc) in the tank 115, the system reduces damage to the components and tubes in the tank 115. This reduces the need for plumbing repairs. The holding device 135 may be comprised of any material such as, for example, plastic, rubber, metal, wood, composite or any other substance that is configured to hold a cleaning substance 150.

In various embodiments, the holding device 135 may include a bottom and a side wall around the bottom. The side wall may be any height. For example, the side wall may extend about ⅜ inch above the bottom of the holding device 135. The entire holding device 135 may be about 1.75 inches wide×about 2⅛ inch in length. The bottom of the holding device 135 may include a first portion 140 that comprises any container that holds, stores or retains the cleaning substance 150. The first portion 140 may be about 1.75 inches×1 inch×3 inches deep. The holding device 135 may include a recessed portion or container to hold the cleaning substance 150. For example, the first portion 140 of the holding device 135 may include a hollow first leg 165 that is configured to hold the cleaning substance. The recessed portion may allow the water to soak in the cleaning substance 150 until a sufficient amount of water is in the first potion 140 of the holding device 135 to exceed the recessed portion and overflow into a second portion 145 of the holding device 135. The recessed portion may be about 1.5 inches×about 1 inch×about 3 inches deep.

The holding device 135 may include a second portion 145 that includes a hole 155. The hole 155 may include an about 0.5 inch inner diameter. For example, the start of the hole 155 may be about 0.25 inches from the edge of the first portion 140. The second portion 145 may extend about 0.25 inches past the hole 155 (on the side opposite of the first portion 140). The hole 155 may be on the bottom of the holding device 135, wherein the hole 155 is configured to be aligned with the overflow pipe 130. The bottom of the second portion 145 may include one or more ridges next to or around the hole 155 such that the ridge may abut the top of the overflow pipe 130. Such a ridge allows the second portion 145 to be above the top of the overflow pipe 130. The ridge may be about ⅛ inch such that the bottom of the hole 155 is about ⅛ inch above the top of the overflow pipe 130. The hole 155 in the bottom of the second portion 145 allows the fill water to flow out of the bottom of the holding device 135 and into the overflow pipe 130. In various embodiments, the hole 155 may be located in any portion of the holding device 135. For example, the hole 155 may be on the side of the holding device 135 and allow the fill water to flow out of the side of the holding device 135 and into the top or side of the overflow pipe 130.

In various embodiments, the holding device 135 may include a component that slides inside an existing overflow pipe 130. In various embodiments, the holding device 135 may include one or more legs. The system may include just a second leg 160 supporting the holding device 135, just a first leg 165 supporting the holding device 135 or both a second leg 160 and a first leg 165 supporting the holding device 135. In various embodiments, a second leg 160 may slide inside of the overflow pipe 130 such that the second leg 160 is received within the overflow pipe 130. In various embodiments, the second leg 160 may slide over the overflow pipe 130 such that the second leg 160 receives the overflow pipe 130. The second leg 160 may be about 0.5 inch inner diameter and about 3 inches in length. The top of the second leg 160 may support at least a portion of the holding device 135. When placed inside of the overflow pipe 130, the bottom of the second leg 160 may be within the overflow pipe 130. The outside of the bottom of the second leg 160 and/or the outside of the bottom of the first leg 165 may include a rubber band-type device (or other cushioning, stabilizing or friction device). The outside of the bottom of the second leg 160 and/or the outside of the bottom of the first leg 165 may include ridges to hold the rubber band in place. The rubber band may help to restrict the second leg 160 and/or first leg 165 from moving (rattling or floating up). When placed over the overflow pipe 130, the bottom of the second leg 160 may cover a portion or all of the overflow pipe 130. The cross-section of the second leg 160 may be any geometric shape (round, oval, rectangle, square, trapezoid, triangle, etc). For example, the cross-section of the second leg 160 may be a circle, such that the second leg 160 forms a round cylinder.

A top of a first leg 165 may extend from at least a portion of the holding device 135. The first leg 165 may be any length. The first leg 165 may be the same length as the second leg 160. The bottom of the first leg 165 may rest on the bottom of the tank 115, next to the overflow pipe 130 to provide extra stability. The cross-section of a leg may be any geometric shape. For example, the cross-section of the first leg 165 may be a rectangle or square, such that the first leg 165 forms a four-sided column. The second leg 160 and/or first leg 165 may each have an equal width on the top and bottom. The second leg 160 and/or first leg 165 may include angled sides such that the leg tapers down from a wider top portion to a narrower bottom portion. The second leg 160 and/or first leg 165 may include angled sides such that the leg tapers up from a wider bottom portion to a narrower top portion. The top of a leg may include a support device for supporting the holding device 135 on the top of the leg. For example, the support device may be a dowel that is perpendicular to a leg that extends beyond the outer borders of the leg to provide a wider base for supporting the holding device 135.

Figure 2:
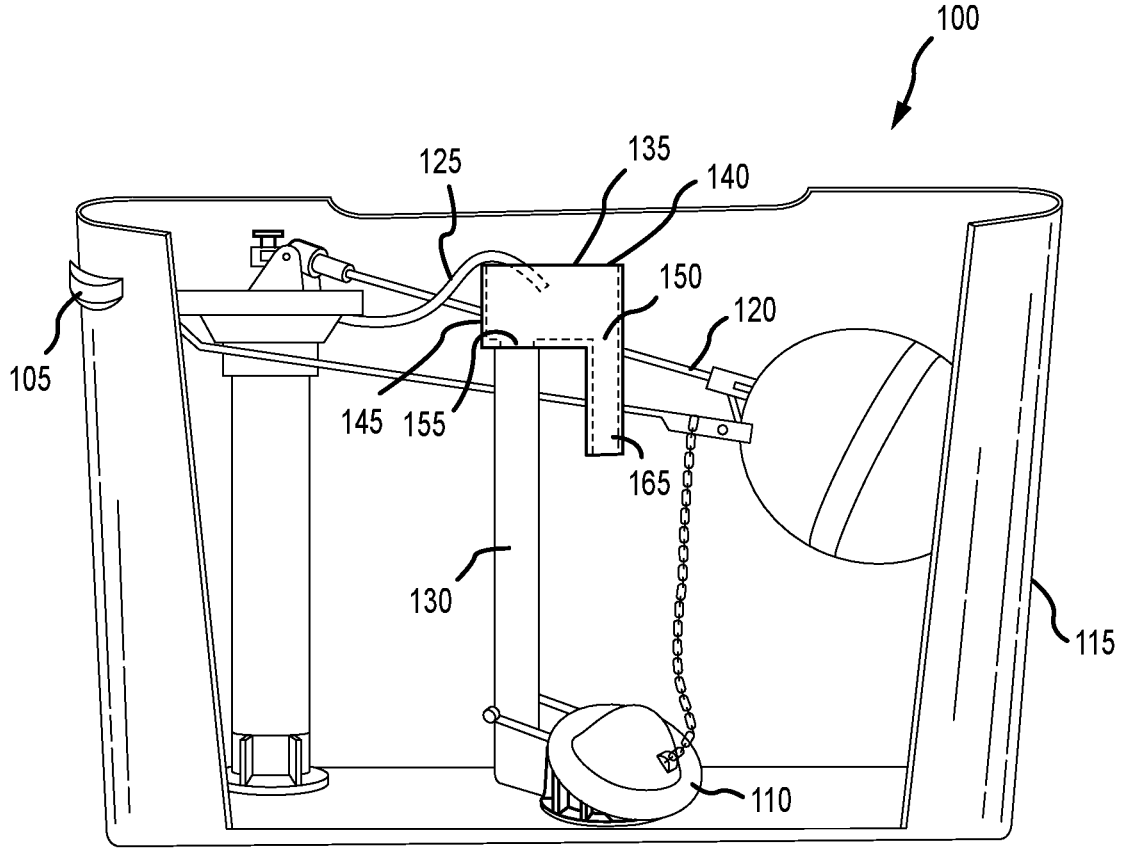
FIG. 2 illustrates a toilet bowl system having the toilet bowl cleaning device integrated with the overflow pipe, in accordance with various embodiments.

In various embodiments, and as set forth in FIG. 2, an overflow pipe 130 may incorporate the holding device 135 as part of an integral unit such that the overflow pipe 130 acts as a second leg 160. As such, the overflow pipe 130 and holding device 135 may be created together in the same molding process. The integrated device may also include a first leg 165. The holding device 135 may be configured to hang off of the overflow pipe 130. For example, the holding device 135 may include a clip or friction-fit ring that attaches the holding device 135 onto the overflow pipe 130 such that the holding device 135 hangs off of the overflow pipe 130. The holding device 135 may include a hole 155 on the bottom of the holding device 135, wherein the hole 155 is aligned with the top of the overflow pipe 130 or the hole 155 receives the overflow pipe 130. The hole 155 may be on the side of the holding device 135 and allow the fill water to flow out of the side of the holding device 135 and into the top or side of the overflow pipe 130.

The method may comprise removing the overflow tube 125 from the overflow pipe 130. Inserting the second leg 160 of the holding device 135 into the overflow pipe 130 and allowing the first leg 165 to hang next to the holding device 135. The cleaning substance 150 is placed into the first portion 140 of the holding device 135. The overflow tube 125 may be placed into or attached to the holding device

135. The overflow tube 125 may be attached to the holding device 135 with the same clip that was used to attach the overflow tube 125 to the overflow pipe 130.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical and mechanical changes may be made without departing from the spirit and scope of the disclosure. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. Furthermore, any reference to singular includes plural embodiments, and any reference to more than one component may include a singular embodiment. Although specific advantages have been enumerated herein, various embodiments may include some, none, or all of the enumerated advantages.

In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure. The scope of the disclosure is accordingly limited by nothing other than the appended claims, in which reference to an element in the singular is not intended to mean "one and only one" unless explicitly so stated, but rather "one or more." Moreover, where a phrase similar to 'at least one of A, B, and C' or 'at least one of A, B, or C' is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Although the disclosure includes a method, it is contemplated that it may be embodied as computer program instructions on a tangible computer-readable carrier, such as a magnetic or optical memory or a magnetic or optical disk. All structural, chemical, and functional equivalents to the elements of the above-described various embodiments that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims. No claim element is intended to invoke 35 U.S.C. § 112(f) unless the element is expressly recited using the phrase "means for" or "step for". As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

I claim:

1. A system comprising:

a holding device having a first portion and a second portion;

the holding device configured to receive fill water;

the first portion of the holding device configured to retain a cleaning substance in a first leg;

the second portion of the holding device configured to allow the fill water to flow into an overflow pipe;

a second leg having a first end interfacing with the holding device;

the second leg having a second end configured to be reciprocally received into the overflow pipe to allow the fill water to flow into the overflow pipe; and the first leg having a first end interfacing with the holding device.

2. The system of claim 1, wherein the first portion of the holding device includes a recessed area.

3. The system of claim 1, wherein the first portion of the holding device includes a recessed area having a geometric shape that matches a geometric shape of the cleaning sub stance.

4. The system of claim 1, wherein the holding device includes a side wall.

5. The system of claim 1, wherein the holding device includes a side wall that is about ⅜ of an inch above a bottom of the holding device.

6. The system of claim 1, wherein the first portion of the holding device is about 1.5 inch×1 inch×3 inch.

7. The system of claim 1, wherein the holding device is configured to receive fill water from a fill tube.

8. The system of claim 1, wherein the holding device includes a cover.

9. The system of claim 1, wherein the holding device includes at least one of a removable cover, a hinged cover or a sliding cover.

10. The system of claim 1, further comprising a rubber band on at least one of the second end of the first leg or the second end of the second leg.

11. The system of claim 1, wherein an outside bottom of the second portion of the holding device includes one or more ridges.

12. The system of claim 1, wherein the first portion of the holding device is configured to allow at least one of a re-fill or replacement of the cleaning substance.

13. The system of claim 1, wherein a geometric shape of the cleaning substance is similar to the geometric shape of the first portion of the holding device.

14. The system of claim 1, wherein the first portion of the holding device is configured to directly receive the cleaning substance.

15. A system comprising:

a holding device having a first portion and a second portion;

the holding device configured to receive fill water;

the holding device integrated with an overflow pipe;

the first portion of the holding device configured to retain a cleaning substance; and the second portion of the holding device configured to allow the fill water to flow into an overflow pipe.

16. The system of claim 15, further comprising a first leg having a first end interfacing with the holding device and a compartment to retain the cleaning substance.

17. The system of claim 16, wherein the first portion of the holding device includes a recessed area.

18. The system of claim 16, wherein the first portion of the holding device includes a recessed area having a geometric shape that matches a geometric shape of the cleaning sub stance.

19. The system of claim 16, wherein the holding device includes a side wall.

20. The system of claim 16, wherein a geometric shape of the cleaning substance is similar to the geometric shape of the first portion of the holding device.

* * * * *